United States Patent [19]

Nakayama et al.

[11] Patent Number: 4,875,947

[45] Date of Patent: Oct. 24, 1989

[54] METHOD FOR PRODUCING GRAIN-ORIENTED ELECTRICAL STEEL SHEET HAVING METALLIC LUSTER AND EXCELLENT PUNCHING PROPERTY

[75] Inventors: Hisanobu Nakayama; Osamu Tanaka; Hiromichi Yasumoto; Seiichi Senoo; Youichi Zaizen; Kouji Yamasaki, all of Kitakyushu, Japan

[73] Assignee: Nippon Steel Corporation, Tokyo, Japan

[21] Appl. No.: 239,191

[22] Filed: Aug. 31, 1988

[30] Foreign Application Priority Data

| | | | |
|---|---|---|---|
| Aug. 31, 1987 | [JP] | Japan | 62-215224 |
| Aug. 31, 1987 | [JP] | Japan | 62-215225 |
| Aug. 2, 1988 | [JP] | Japan | 63-193297 |

[51] Int. Cl.[4] ..... H01F 1/04

[52] U.S. Cl. ..... 148/113; 148/112

[58] Field of Search ..... 148/111, 112, 113

[56] References Cited

U.S. PATENT DOCUMENTS

| | | | |
|---|---|---|---|
| 3,039,902 | 6/1962 | Miller et al. | 148/113 |
| 3,582,407 | 6/1971 | Steger et al. | 148/113 |
| 3,615,918 | 10/1971 | Evans et al. | 148/113 |
| 3,697,322 | 10/1972 | Lee et al. | 148/113 |
| 3,841,925 | 10/1974 | Steger | 148/113 |
| 3,932,201 | 1/1976 | Steger | 148/113 |
| 4,171,994 | 10/1979 | Miller | 148/113 |
| 4,186,038 | 1/1980 | Maucione | 148/113 |
| 4,242,155 | 12/1980 | Morito et al. | 148/113 |
| 4,512,823 | 4/1985 | Howe et al. | 148/113 |
| 4,543,134 | 9/1985 | Tanaka et al. | 148/113 |
| 4,775,430 | 10/1988 | Tanaka et al. | 148/113 |

FOREIGN PATENT DOCUMENTS

| | | | |
|---|---|---|---|
| 53-22113 | 3/1978 | Japan . | |
| 55-89423 | 7/1980 | Japan . | |
| 56-65983 | 6/1981 | Japan . | |
| 59-96278 | 6/1984 | Japan . | |
| 60-89521 | 5/1985 | Japan | 148/111 |
| 1426150 | 2/1976 | United Kingdom | 148/113 |

*Primary Examiner*—John P. Sheehan

*Attorney, Agent, or Firm*—Kenyon & Kenyon

[57] ABSTRACT

A method for producing grain-oriented electrical steel sheet having metallic luster and excellent punching property comprises the steps of decarbonization annealing a grain-oriented electrical steel sheet which has been cold rolled to a final thickness, coating the decarbonization-annealed sheet with an annealing separator consisting of magnesium blended with one or more salts of alkali metal or alkaline-earth metal, and finish annealing the coated sheet.

4 Claims, No Drawings

METHOD FOR PRODUCING GRAIN-ORIENTED ELECTRICAL STEEL SHEET HAVING METALLIC LUSTER AND EXCELLENT PUNCHING PROPERTY

BACKGROUND OF THE INVENTION

1. Field of the Invention

This invention relates to a method for producing glass-less grain-oriented electrical steel sheet exhibiting metallic luster and more particularly to such a steel sheet having very superior punching property.

2. Description of the prior art

Grain-oriented electrical steel sheet is generally produced as follows. A silicon steel slab containing not more than 4.0% Si is hot rolled, optionally annealed, subjected to a single cold rolling or two or more cold rollings alternately with intermediate annealing, and then cold rolled to the final sheet thickness. It is then subjected to decarbonization annealing to produce a $SiO_2$-containing oxide film on its surface, whereafter an annealing separator consisting mainly of MgO is applied to the surface thereof and dried. The sheet is then wound into a coil and subjected to high-temperature finish annealing. As a result, the formation of Goss texture secondary recrystallization grains is promoted and a glass film is formed on the sheet surface. If required, the sheet is coated with an insulating coating liquid and then baked to form an insulating film thereon.

Grain-oriented electrical steel sheet is used as a material for the iron cores of dynamos, transformers and other electrical equipment. Ordinarily such a core is fabricated by punching or shearing the sheet into appropriately shaped core plates by use of a steel die and then laminating the core plates to obtain the core. In fabricating an iron core for a turbine generator, for example, the number of core plates required amounts to 100 to 200 thousand. Moreover, it is necessary to hold the punching burr height of these plates to not more than, for instance, 15 μm. This is important for the purpose of preventing an abnormal increase in core loss caused by shorting of the edges of the core plates after they have been laminated to form the core.

The surface of grain-oriented electrical steel sheet is coated with a glass film or with both a glass film and an insulating film. As the glass film has high hardness, it increases the wear of the die during the punching operation. For this reason, punching burr tends to occur after several thousand punching operations and it becomes necessary to repolish the die or to replace it with a new one. This greatly reduces the efficiency of the work and leads to an increase in cost.

A method for producing grain-oriented electrical steel sheet having metallic luster is disclosed, for example, in Japanese Published Unexamined Patent Application No. 53(1978)-22113. According to the disclosed method, the thickness of the oxide film produced during decarbonization annealing is held to not more than 3 μm and fine alumina powder blended with 5–40% of hydrated silica mineral powder is used as the annealing separator. After being coated with this separator, the steel sheet is finish annealed. This method produces certain good effects such as that a thin oxide film is obtained, the presence of the hydrated silica makes it possible to form a glass film that separates easily, and the product has a metallic luster.

As one known annealing separator which suppresses the formation of a glass film, there is known that disclosed in Japanese Published Unexamined Patent Application No. 55(1980)-89423 which uses an annealing separator consisting of fine alumina powder blended with 5–30% hydrated silica mineral powder, an Sr compound, a Ba compound, calcium oxide and calcium hydroxide, the annealing separator being applied to the steel sheet prior to finish annealing. As another there is known that disclosed in Japanese Published Unexamined Patent Application No. 561981)-65983 which uses an annealing separator consisting alumina hydroxide blended with of 20 parts by weight of an impurity removing additive and 10 parts by weight of a suppressing agent, the separator being applied to the steel sheet to form a thin glass film of a thickness of 0.5 mm or less.

Further, Japanese Published Unexamined Patent Application No. 59(1984)-96278 discloses an annealing separator consisting of $Al_2O_3$, which has low reactivity toward the $SiO_2$ in the oxide film formed during decarbonization annealing, and MgO calcined at more than 1,300° C. to reduce its reactivity. The method of this application produces a useful effect in that it suppresses the formation of a forsterite film (glass film).

On an actual production line, however, fluctuations sometimes arise in the dew point or constitution of the gas atmosphere during decarbonization annealing, for example. Also, local variations arise in the thickness of the oxide film formed on the surface of the steel plate. Furthermore, depending on its history, the steel plate itself undergoes variation in oxidation in the widthwise or lengthwise direction. On the other hand, methods for removal of glass film are known but entail the risk of non-uniform removal. At any rate, up to the present there has been no method for consistent production of grain-oriented electrical steel sheet exhibiting metallic luster.

SUMMARY OF THE INVENTION

The object of the present invention is to provide a method for producing grain-oriented electrical steel sheet having metallic luster and excellent punching property.

DETAILED DESCRIPTION OF THE INVENTION

In the production of grain-oriented electrical steel sheet, hot rolling is generally followed by optional annealing, a single cold rolling or two or more cold rollings alternately with intermediate annealings, cold rolling to the final sheet thickness, decarbonization annealing, application of an annealing separator, winding into a coil, and finish annealing. The present invention does not particularly specify the steel constituents or the steps up to that in which the steel sheet is rolled to the final thickness, and these can be freely selected.

The grain-oriented electrical steel sheet which has been cold rolled to the final sheet thickness is decarbonization annealed. This decarbonization annealing removes carbon from the steel, causes primary recrystallization and forms an oxide film containing $SiO_2$ on the surface of the sheet.

After decarbonization annealing, the grain-oriented electrical steel sheet is coated with an annealing separator. At this time it is important that the composition of the annealing separator be such that no glass film forms during finish annealing but instead the sheet surface comes to exhibit a metallic luster.

In the present invention there is used an annealing separator consisting of 100 parts by weight (hereinafter referred to simply as "parts") of magnesia (MgO) blended with 2–40 parts of one or more salts of members selected from among such alkali metals as Li, Na, K and Rb and such alkaline-earth metals as Ca, Ba, Mg and Sr.

When there is used an annealing separator consisting of not less than 2 parts of a salt of an alkali metal or an alkaline-earth metal blended with 100 parts of magnesia, reaction between the magnesia and the $SiO_2$ during finish annealing is suppressed, whereby glass film is not formed. This is because the salt in the annealing separator decomposes the $SiO_2$ in the oxide film. To realize this effect, it is necessary for the annealing separator to contain not less than 2 parts of the salt per 100 parts of the magnesia. When less salt is contained, an adhesive glass film is formed or glass film is locally formed, giving a non-uniform appearance and degrading the quality of the product. On the other hand, when the amount of the salt blended with the magnesium is too great, sticking occurs during the finish annealing. Also, where an insulating film is to be formed by coating with an insulating coating liquid followed by baking, it becomes difficult to remove the annealing separator in the preceding step of light pickling. To preclude these problems, the content of the salt is specified as not more than 40 parts.

When grain-oriented electrical steel sheet is coated with this annealing separator and finish annealed, the entire surface of the sheet will be free from glass film over the entire length thereof, not withstanding any variation that may exist in the thickness of the oxide film at the time of decarbonization annealing, and will exhibit metallic luster and superior punching property.

In the method of the present invention, since use of too low an annealing temperature causes the time required for decarbonization to become impracticably long and may result in incomplete decarbonization, the annealing temperature is specified as not less than 800° C. On the other hand, since use of too high a temperature hinders the decarbonization and increases the amount of oxide layer formed, which in turn increases the probability of a nonuniform glass film remaining after finish annealing, this temperature is further specified as not more than 850° C. While there is no need to prescribe the decarbonization annealing time, it is preferably 90–180 sec. The annealing is carried out in an atmosphere of $H_2$, $N_2$, Ar, $H_2O$ and a small amount of CO and $CO_2$. It is important to control the rate of oxidization by this gas atmosphere. When the oxidization rate $PH_2O/PH_2$ is low, the decarbonization becomes insufficient, which has an adverse effect on the electrical properties of the sheet. Thus $PH_2O/PH_2$ is specified as not less than 0.25. When the oxidization rate is too high, a large amount of oxide layer is formed and an irregular glass film is likely to remain following finish annealing. Thus the upper limit on this rate has been set at 0.55.

After finish annealing, the grain-oriented electrical steel sheet is subjected to flattening annealing for straightening it into sheet form. At this time, an oxide layer will form on the sheet surface with metallic luster even though every effort is made to maintain the atmosphere as dry as possible. This oxide layer degrades both the punching property and the electrical characteristics of the sheet.

Experiments were conducted for finding a way to eliminate this problem and it was found that a marked improvement in punching property and good electrical properties can be obtained by coating the surface of the grain-oriented electrical sheet having metallic luster with an inorganic coating, then carrying out flattening annealing, and thereafter applying an organic coating to the sheet surface.

As the inorganic coating there can be used one consisting of one or more of, for example, phosphates such as phosphoric acid, aluminum phosphate, magnesium phosphate, calcium phosphate, zinc phosphate and manganese phosphate, chromates such as chromic acid, magnesium chromate, aluminum chromate, calcium chromate and zinc chromate, dichromate and colloidal silica. A coating weight of 0.5–2.5 g/m$^2$ is preferable. The inorganic coating can have boric acid, borate or silicate added thereto.

Following application of the inorganic coating, flattening annealing is carried out at 800°–870° C. This temperature range is selected as the most effective for straightening the shape of sheet. In this invention, since the steel sheet is covered with the aforesaid coating, it experiences absolutely no oxidation by the gas atmosphere, which results in improved punching property and ensures good electrical properties.

Next, an organic insulating coating is applied to the sheet and baked thereon at, for example, 250°–350° C. to form an insulating film. As the organic coating there can be used, for example, one of acrylic type or of styrene, polyvinyl, melamine, phenol, silicon, vinyl acetate, epoxy or the like. An organic coating blended with an inorganic coating is also usable. Use of the organic coating by itself improves the punching property of the grain-oriented electrical steel sheet. A further dramatic improvement in punching property can be realized, however, by first preventing the formation of an oxide film through the provision of the inorganic coating and then further applying and baking on the organic coating.

Any method can be used for applying the annealing separator to the grain-oriented electrical steel sheet. For example, it can be applied in the form of a slurry or by electrostatic painting.

EXAMPLE 1

A grain-oriented electrical steel sheet consisting of 0.046% C, 3.12% Si, 0.057% Mn, 0.022% S and the balance of Fe and unavoidable impurities was hot rolled to a thickness of 2.3 mm. The hot-rolled sheet was then cold rolled twice to a sheet thickness of 0.35 mm, with intermediate annealing at 980° C. for three minutes being carried out between the two cold rollings. The cold-rolled sheet was then decarbonization annealed in a wet hydrogen atmosphere. Next specimens of the sheet were coated with annealing separators of the compositions shown in Table 1 and subjected to finish annealing at 1,200° C. for 20 hours. In the ensuing continuous heat flattening step, a coating of phosphate plus colloidal silica was applied to and baked on the specimens in such amount as to obtain a coating weight after baking of 2 g/m$^2$.

The resulting specimens were examined for appearance, punching property and electrical properties. The results are also shown in Table 1.

TABLE 1

| Specimen No. | Annealing separator (parts by weight) MgO | $Al_2O_3$ | Additives | Appearance | Punching property** (after coating with phosphate) | Magnetic properties $B_{10}$ (T) | $W_{17/50}$ (W/kg) | Remarks |
|---|---|---|---|---|---|---|---|---|
| 1 | 100 | | LiCl: 5 | Completely free of glass film; uniform metallic luster | 3.8 ($10^4$ times) | 1.87 | 1.30 | Invention |
| 2 | " | | KCl: 5 | Completely free of glass film; uniform metallic luster | 3.6 ($10^4$ times) | 1.87 | 1.30 | " |
| 3 | " | | $CaCl_2$: 5 | Completely free of glass film; uniform metallic luster | 5 ($10^4$ times) | 1.88 | 1.28 | " |
| 4 | " | | $BaCl_2$: 5 | Completely free of glass film; uniform metallic luster | 3.5 ($10^4$ times) | 1.87 | 1.29 | " |
| 5 | " | | $CaCl_2$: 5 + LiCl: 5 | Completely free of glass film; uniform metallic luster | 6 ($10^4$ times) | 1.87 | 1.29 | " |
| 6 | " | | $CaCl_2$: 5 + KCl: 5 | Completely free of glass film; uniform metallic luster | 6.2 ($10^4$ times) | 1.88 | 1.29 | " |
| 7 | " | | $CaCl_2$: 5 + BaCl: 5 | Completely free of glass film; uniform metallic luster | 6.5 ($10^4$ times) | 1.88 | 1.28 | " |
| Comparative example 1 | 100 | 0 | 0 | Complete glass film | 0.6 ($10^4$ times) | 1.87 | 1.33 | Comparative example |
| Comparative example 2 | MgO calcined at 1,700° C.: 60 | 100 | $MgSO_4.7H_2O$: 6 | Metallic luster but somewhat irregular | 3 ($10^4$ times) | 1.87 | 1.30 | Comparative example |

*Number of punching operations with a 5 mm diameter steel die before heigh of punching-burr became 50 μm.

As can be seen from Table 1, all specimens prepared using an annealing separator satisfying the component content ratios of this invention (No. 1–7) were free of a glass film and exhibited metallic luster as well as good punching property, as compared not only with Comparative Example No. 1 prepared using a conventional annealing separator for providing a complete coating film but also with Comparative Example No. 2 prepared using an annealing separator claimed not to produce a substrate coating film.

Moreover, the specimens prepared according to the method of the present invention exhibited good electrical properties (magnetic flux density $B_{10}$ and core loss $W_{17/50}$).

As the grain-oriented electrical steel sheet according to the present invention has no glass film on its surface whatsoever, it not only exhibits improved punching property but is also provided with enhanced electrical properties by facilitating the movement of the magnetic domain walls in the process of magnetization.

EXAMPLE 2

There was used a 0.35 mm decarbonization-annealed sheet obtained in the same manner as that in Example 1. Specimens of the decarbonization-annealed sheet were coated with annealing separators of the component content ratios shown in Table 2 at the rate of 8 g/m$^2$ per side and were then subjected to finish annealing at 1,200° C. for 20 hours. In the ensuing continuous heat flattening step, a coating of aluminum phosphate plus colloidal silica was applied to the specimens at the rate of 2 g/m$^2$ and baked thereon. The appearance, punching property and magnetic properties of the so-obtained products are shown Table 2. The punching property was evaluated by the same method as in Example 1.

TABLE 2

| Specimen No. | Annealing separator (parts by weight) MgO | $CaCl_2$ | Appearance | Punching property** (after coating with phosphate) | Magnetic properties $B_{10}$ (T) | $W_{17/50}$ (W/kg) | Remarks |
|---|---|---|---|---|---|---|---|
| Comparative example 1 | 100 | 0 | Uniform glass film | 0.6 ($10^4$ times) | 1.85 | 1.32 | Comparative example |
| 2 | " | 2 | Almost no glass film | 4.2 ($10^4$ times) | 1.86 | 1.30 | Invention |
| 3 | " | 5 | Completely free of glass film; grains exposed | 5.1 ($10^4$ times) | 1.87 | 1.27 | " |
| 4 | " | 10 | Completely free of glass film; grains exposed | 6.3 ($10^4$ times) | 1.87 | 1.25 | " |
| 5 | " | 20 | Completely free of glass film; grains exposed | 6.7 ($10^4$ times) | 1.87 | 1.26 | " |
| 6 | " | 30 | Completely free of glass film; grains exposed | 6.5 ($10^4$ times) | 1.87 | 1.28 | " |

While slight formation of a glass film was noted in the case of adding only 2 parts $CaCl_2$, the improvement in punching property was nevertheless considerable. Addition of five or more parts of $CaCl_2$ resulted in a sheet having no glass film whatsoever, complete uniform exposure of the metal surface, good appearance and highly superior punching property.

EXAMPLE 3

A grain-oriented electrical steel sheet consisting of 0.045% C, 3.08% Si, 0.060% Mn, 0.024% S and the balance of Fe and unavoidable impurities was hot rolled to a thickness of 2.3 mm. The hot-rolled sheet was then cold rolled twice to a sheet thickness of 0.35 mm, with intermediate annealing at 950° C. for three minutes being carried out between the two cold rollings. Specimens of the cold-rolled sheet were then decarbonization-annealed under the conditions shown in Table 3. The specimens were coated with annealing separators of the compositions shown in Table 3 and subjected to finish annealing at 1,200° C. for 20 hours. A coating liquid of phosphate plus colloidal silica was applied to the specimens and baked thereon in a step that also served the purpose of flattening annealing. The resulting specimens were examined for appearance, punching property and magnetic properties. The results are shown in Table 4.

TABLE 3

| Specimen No. | Decarbonization annealing** Temperature (°C.) | $PH_2O/PH_2$ | Additive per 100 parts by weight of MgO (in parts by weight) | Remarks |
|---|---|---|---|---|
| 1 | 810 | 0.28 | $CaCl_2$ 10 | Invention |
| 2 | " | 0.45 | " | Invention |
| 3 | " | 0.58 | " | Comparative example |
| 4 | 800 | 0.35 | " | Invention |
| 5 | 865 | 0.35 | " | Comparative example |
| 6 | 810 | 0.35 | No addition | Comparative example |

*Uniform heating time: 150 sec

TABLE 4

| No. | Appearance | Punching property** (after coating with phosphate) | Magnetic properties $B_8$ (T) | $W_{17/50}$ (W/kg) | C content after decarbonization (ppm) |
|---|---|---|---|---|---|
| 1 | Free from uniform film over entire | 6.3 ($10^4$ times) | 1.87 | 1.32 | 22 |
| 2 | Free from uniform film over entire | 5.8 | 1.88 | 1.28 | 14 |
| 3 | Some irregularity along edges; slight film formation | 2.3 | 1.87 | 1.36 | 8 |
| 4 | Free from uniform film over entire | 5.9 | 1.88 | 1.30 | 16 |
| 5 | Irregularity along edges; slight film formation | 1.4 | 1.87 | 1.35 | 33 |
| 6 | Uniform glass film | 0.7 | 1.86 | 1.36 | 18 |

*Number of punching operations with a 5 mm diameter steel die before height of punching-burr became 50 μm.

All specimens prepared under the conditions of 810° C., $PH_2O/PH_2=0.28$, 0.45, and 800° C., $PH_2O/PH_2=0.35$, which conditions satisfy the present invention, incurred no formation of glass film, exhibited metallic luster and had good punching property. In contrast, the specimen according to the comparative example was uniformly formed with a glass film and exhibited poor punching property. More specifically, in specimen No. 3 which was prepared using too high a value of $PH_2O/PH_2$ and in specimen No. 5 which was prepared using too high a temperature, because of the occurrence of such irregularities as the formation of film at the edge portions and slight formation of film throughout, the punching property was poor. Further, analysis conducted to determine residual C after decarbonization revealed an abnormality in specimen No. 5.

EXAMPLE 4

A cold-rolled sheet of a final thickness of 0.35 mm prepared after the manner of Example 3 was decarbonization annealed at 820° C. for 150 seconds in an atmosphere of $N_2+H_2$ at an oxidation rate $PH_2O/PH_2=0.35$. Specimens of the so-obtained sheet were coated with the annealing separators shown in Table 5 and subjected to finish annealing at 1,200° C. for 20 hours. Then, on a continuous coating line, the specimens were subjected to heat flattening and treatment to bake a coating consisting primarily of colloidal silica and orthophosphate thereon. The properties of the so-obtained products are shown in Table 5.

TABLE 5

| No. | Additive per 100 parts by weight of MgO (in parts by weight) | Appearance | Punching property (after coating with phosphate) | Magnetic properties $B_8$ (T) | $W_{17/50}$ (W/kg) |
|---|---|---|---|---|---|
| 1 | $BaCl_2$ 10 | Uniform metallic luster over entire surface | 6.7 ($10^4$ times) | 1.89 | 1.28 |
| 2 | $MgCl_2$ 10 | Uniform metallic luster over almost entire surface | 4.8 ($10^4$ times) | 1.87 | 1.32 |
| 3 | $CaCl_2$ 10 | Uniform metallic luster over entire surface | 7.6 ($10^4$ times) | 1.89 | 1.28 |
| 4 | LiCl 10 | Uniform metallic luster over entire surface | 5.9 ($10^4$ times) | 1.88 | 1.30 |
| 5 | KCl 10 | Uniform metallic luster over entire surface | 6.2 ($10^4$ times) | 1.88 | 1.32 |
| 6 | None (comparative example) | Uniform glass film | 0.5 ($10^4$ times) | 1.87 | 1.38 |

EXAMPLE 5

A slab consisting of 0.04% C, 3.1% Si, 0.06% Mn, 0.02% S, 0.001% Al, 0.005% N and the balance of Fe and unavoidable impurities was heated to 1,400° C. and finished as a 21 mm hot-rolled coil. After pickling, the coil was reduced to 0.75 mm by primary cold rolling, subjected to intermediate annealing at 950° C. for 60 seconds, and reduced to 0.35 mm by final cold rolling. The cold-rolled sheet was decarbonization annealed at 840° C., coated with MgO containing 10 wt% $CaCl_2$, and finish annealed The sheet was then washed with water to remove MgO and subjected to flattening annealing (at 850° C. for 90 sec) and insulation coating (300° C. for 10 sec), whereafter specimens thereof were treated in the following four ways:

Case 1: The specimen was coated with an aluminum phosphate inorganic coating at a coating weight after drying of 2 g/m$^2$ and then flattening annealed.

Case 2: The specimen was flattening annealed in a dry atmosphere of 98% $N_2$ plus 2% $H_2$, coated with an organic coating consisting of a magnesium phosphate base containing organic acryl at a coating weight of 2 g/m$^2$, and baked.

Case 3: A speciment treated as in Case 1 was coated with an organic coating consisting of a magnesium phosphate base containing organic acryl at a coating weight of 2 g/m$^2$, and baked.

Case 4: A specimen treated as in Case 1 was coated with an organic epoxy resin at a coating weight of 2 g/m$^2$, and baked.

The so-obtained specimens were tested for punching property and electrical properties. The results are shown in Table 6.

TABLE 6

| No. | Punching property Number of punching operations before punching-burr height reached 30 μm (in tens of thousands of times) | Magnetic properties $W_{17/50}$ (W/kg) | $B_8$ (T) | Remarks |
|---|---|---|---|---|
| 1 | 2 | 1.31 | 1.85 | Comparative example |
| 2 | 32 | 1.45 | 1.83 | Comparative example |
| 3 | 71 | 1.31 | 1.85 | Invention |
| 4 | 75 | 1.30 | 1.86 | Invention |

Punching conditions: Steel die; punching diameter, 5 mm; clearance, 9%; 400 strokes/min While the comparative examples were formed with a uniform glass film and exhibited poor punching property, the specimens according to the present invention were all free of glass film, exhibited metallic luster and had excellent punching property.

What is claimed is:

1. A method for producing grain-oriented electrical steel sheet having metallic luster and excellent punching property comprising the steps of decarbonization annealing, at a temperature of 800° to 850° C. and in an atmosphere whose rate of oxidation $PH_2O/PH_2$ is 0.25 to 0.55, a grain-oriented electrical steel sheet which has been cold rolled to a final thickness, coating the sheet with an annealing separator consisting of 100 parts by weight of magnesia blended with 2 to 40 parts of one or more chlorides of members selected from the group consisting of Li, Na, K, Rb, Ca, Ba, Mg, and Sr, and finish annealing the sheet.

2. The method as claimed in claim 1 wherein, the annealing separator consists of 100 weight parts of magnesium blended with 2–40 parts of $CaCl_2$.

3. The method as claimed in claim 1 further comprising the steps of coating the surface of the finish annealed sheet with an inorganic coating, flattening annealing the coated sheet, and coating the flatten annealed sheet with an organic coating.

4. The method as claimed in claim 1 further comprising the steps of coating the surface of the finish annealed sheet with an inorganic coating, flattening annealing the coated sheet, and coating the flattening-annealed sheet with a coating consisting of an inorganic coating agent base having an organic coating agent blended therewith.

* * * * *

UNITED STATES PATENT AND TRADEMARK OFFICE

CERTIFICATE OF CORRECTION

PATENT NO. : 4,875,947

DATED : Oct. 24, 1989

INVENTOR(S) : H. Nakayam, et al.

It is certified that error appears in the above-identified patent and that said Letters Patent is hereby corrected as shown below:

Column 2, line 9, change "561981)" to --56(1981)--.

Column 2, line 10, between "consisting" and "alumina" insert --of--.

Column 5, line 25 (Table 1), change "$MgSO_4$·7" to --$MgSO_4$·7--.

Column 5, line 27, change "heigh" to --height--.

Column 7, Table 4, numbers 1, 2, and 4, after "entire" insert --surface--.

Column 10, line 22, change "flatten" to --flattening--.

Signed and Sealed this

Twelfth Day of February, 1991

*Attest:*

HARRY F. MANBECK, JR.

*Attesting Officer*

*Commissioner of Patents and Trademarks*